United States Patent [19]

Ralston

[11] Patent Number: 4,926,300

[45] Date of Patent: May 15, 1990

[54] DISPOSABLE FLASHLIGHT WITH IMPROVED ACTIVATOR FIELD OF THE INVENTION

[75] Inventor: Gene O. Ralston, Toluca, Ill.

[73] Assignee: Key Industries, Inc., East Peoria, Ill.

[21] Appl. No.: 322,655

[22] Filed: Mar. 13, 1989

[51] Int. Cl.[5] ..... F21L 7/00

[52] U.S. Cl. ..... 362/189; 362/200

[58] Field of Search ..... 362/157, 181, 200, 201, 362/205

[56] References Cited

U.S. PATENT DOCUMENTS

| | | | |
|---|---|---|---|
| 1,347,423 | 7/1920 | Vince . | |
| 2,779,344 | 1/1957 | Hemmings et al. . | |
| 2,848,598 | 8/1958 | Amlee . | |
| 3,206,594 | 9/1965 | Brown . | |
| 3,256,428 | 6/1966 | Schwartz . | |
| 3,758,773 | 9/1973 | Nau . | |
| 3,787,677 | 1/1974 | Molitor . | |
| 3,796,869 | 3/1974 | Stone | 362/189 |
| 4,032,772 | 6/1977 | Mowbray . | |
| 4,032,773 | 6/1977 | Halliday, Jr. et al. | 362/189 |
| 4,122,510 | 10/1978 | Halliday, Jr. | 362/189 |
| 4,242,724 | 12/1980 | Stone | 362/189 |
| 4,419,718 | 12/1983 | Chabria | 362/189 |
| 4,448,333 | 4/1984 | Fazzina | 362/189 |
| 4,628,418 | 12/1986 | Chabria | 362/189 |
| 4,644,451 | 2/1987 | Chabria | 362/189 |
| 4,731,712 | 3/1988 | Amthor | 362/189 |
| 4,745,529 | 5/1988 | Hamlen | 362/157 |
| 4,819,140 | 4/1989 | Griffin | 362/189 |

FOREIGN PATENT DOCUMENTS

| | | | |
|---|---|---|---|
| 1443787 | 5/1966 | France . | |
| 2151765 | 7/1985 | United Kingdom | 362/157 |

*Primary Examiner*—Ira S. Lazarus
*Assistant Examiner*—Sue Hagarman
*Attorney, Agent, or Firm*—Ferrill and Logan

[57] ABSTRACT

A disposable flashlight comprising a hollow flexible outer casing having a first end and a second end, a top end cap member for attachment to said first end, the end cap member having an aperture for an electric lamp device and a bottom end cap for attachment to said second end. A battery holding member is placed within the outer casing, the holding member comprising parallel first and second concave battery jackets; a first battery having a positive terminal and a negative terminal, said first battery being placed in the first jacket with its positive terminal proximate to said bottom end cap; a second battery having a positive terminal and a negative terminal, said second battery being placed in said second jacket with its positive terminal proximate to said top end. An electric lamp means is in electrical contact with the batteries and extends through the aperture. A mechanical activator comprising an electric contact member in contact with the positive terminal of said first battery and extending parallel to the bottom end cap, a flexible metal shield held rigid by said contact member and extending along an inside surface of said outer casing, said shield having an inward bent extension proximate to said negative terminal of said second battery for completing a circuit and activating said light when said outer casing and said metal shield is depressed.

8 Claims, 2 Drawing Sheets

FIG. 1
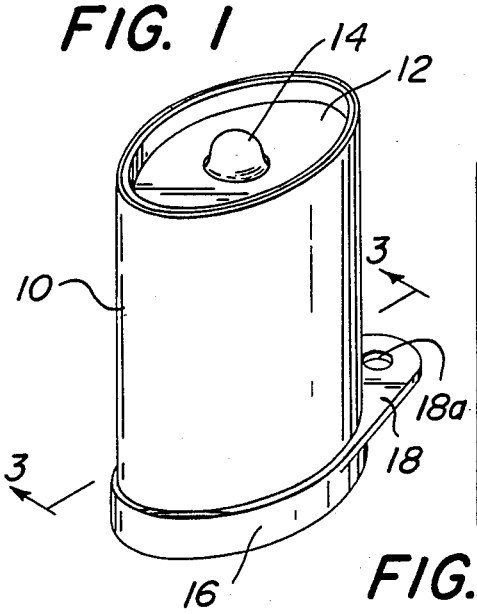
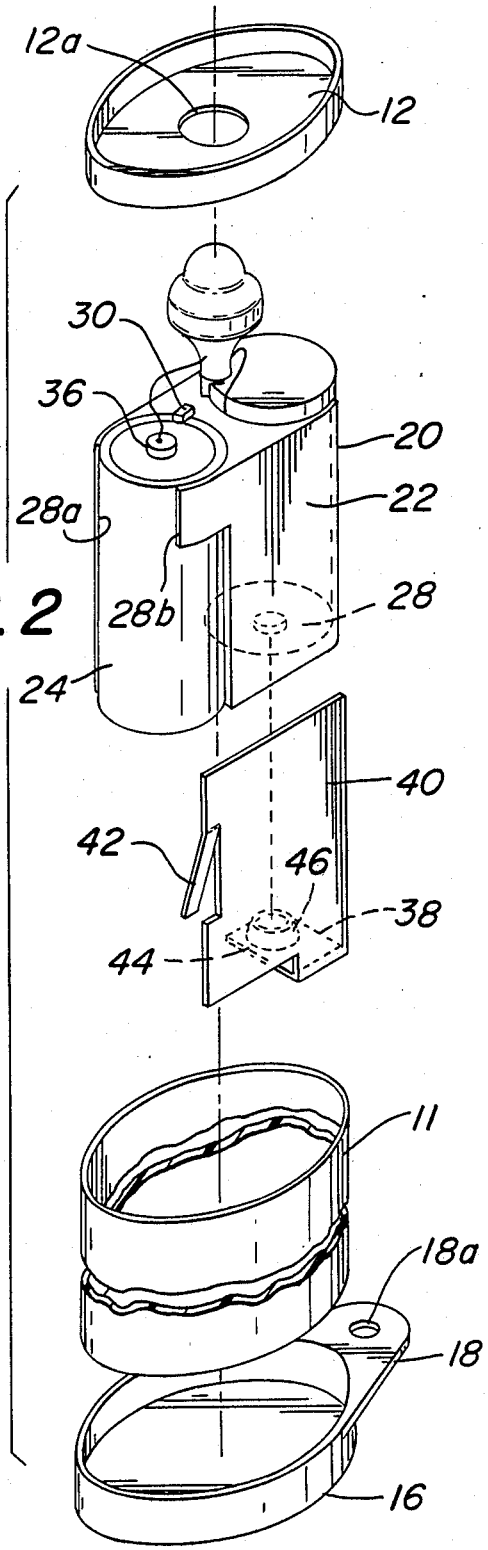
FIG. 2
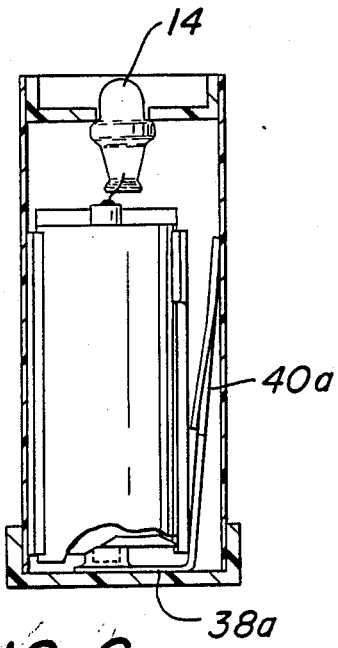
FIG. 6

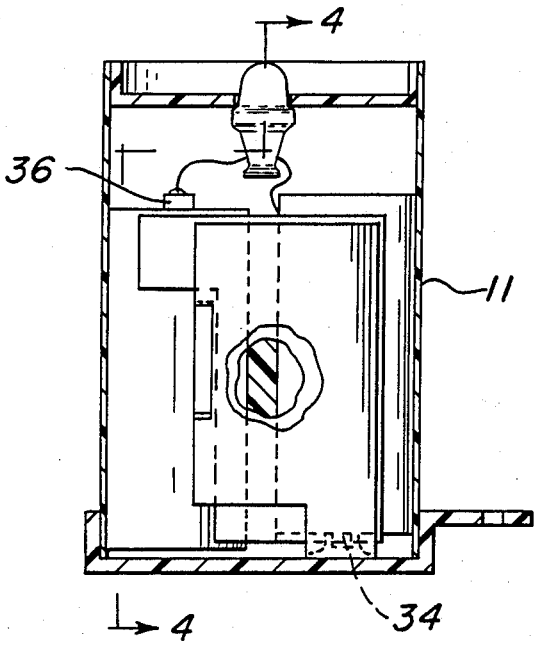
FIG. 3
FIG. 4
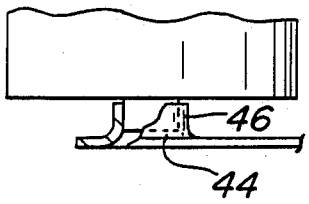
FIG. 5
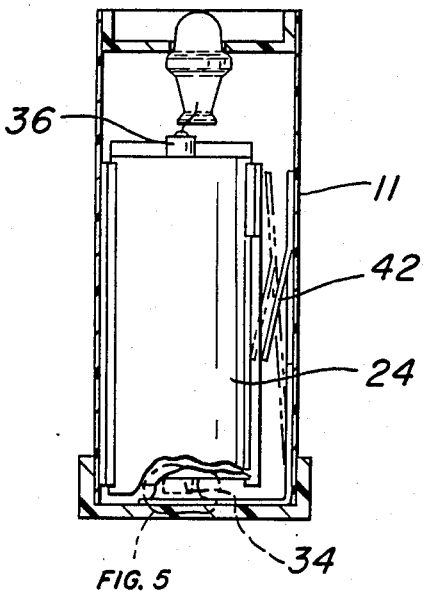

DISPOSABLE FLASHLIGHT WITH IMPROVED ACTIVATOR FIELD OF THE INVENTION

FIELD OF THE INVENTION

The present invention relates in general to disposable flashlights and the electrical circuitry and connections therefor, and is more particularly directed to an improved activation mechanism for a disposable flashlight which when depressed, completes an electric circuit and illuminates the miniature lamp of a disposable flashlight.

BACKGROUND OF THE INVENTION

Numerous styles of miniature flashlights have enjoyed considerable commercial success due to their compactness, utility and reliability. In general, these miniature flashlights are designed to be carried in a purse, pocket or briefcase. Such flashlights may either be disposable or have replaceable batteries and lamps.

In general, disposable flashlights of this type contain two triple AAA batteries which are alternatingly configured within a plastic casing. A container or holder typically comprising two parallel extending concave tubes or cradles secures and maintains the relative position of the batteries. The circuit between the two batteries is open. An activator or switch mechanism, activated by pressure on the plastic outer casing, closes the circuit between the batteries and activates the electric light. When the pressure is released, the circuit is broken and the light turns off.

Of particular importance to the reliability of such flashlights is their ability to light and activate upon the application of pressure at any portion of the enclosing resilient plastic case. The reliability of miniature flashlights is extremely important because they are usually called upon to operate, for example, when a person is hurriedly searching for a key hole during evening hours or a power failure.

There are numerous prior art activators for activating disposable flashlights. The prior art is characterized largely by flashlights having diagonally extending metal activators or wires which are attached to the positive terminal of a first battery, and which upon depression of the outer casing, complete a circuit by contacting the negative terminal of the second battery. The batteries disclosed in U.S. Pat. Nos. 4,419,718; 4,644,451; and 4,628,418 exemplify this design.

Activators such as those disclosed in these patents have several disadvantages. Most notably, they have small surface areas and must therefore be depressed from a central or specific location on the outer casing or jacket. If the outer casing is not depressed at the central or specific location, the activator will not complete the circuit and the flashlight will not light. In addition, activators having this design are typically pre-bent so as to avoid shorting out of the first battery and so as to further maintain the integrity of the switching mechanism. This pre-bending often results in reduced resiliency and a reduced useful life.

Activators having this design also typically utilize the internal plastic battery holding container as a fulcrum. Because of the small surface area and mass of the activator, they can easily lose their resiliency and fail to activate, or, alternatively, may activate upon the application of very little pressure. Thus, the light might be activated by the pressure of a closed handbag or carrying case, thereby exhausting the batteries without the knowledge of the user. In addition, wire contacts such as that disclosed in U.S. Pat. No. 4,419,718 can break after extended use. Finally, disposable flashlights are often distributed or sold for promotional purposes. Such flashlights contain cardboard sleeves within a transparent hollow casing. Such sleeves may also distort operation and cause flashlight malfunction.

It would be desirable to have a disposable flashlight which could be activated from any portion of an enclosing plastic jacket.

It would further be desirable to have a disposable flashlight having a resilient metal activator which does not have to be pre-bent or activated with respect to a fulcrum and will not lose its resiliency after extended use.

It would be further desirable to have a disposable flashlight having an activator of sufficient strength and resiliency such that it will not break off after extended use.

A principal objective of the present invention then is to provide a disposable flashlight having an activator which can be depressed from any section of the plastic outer casing.

A further objective of the invention is to provide a flashlight having a resilient cartridge-type holder for the accommodation of a pair of batteries, a lamp and electric circuitry for the the illumination of the lamp capable of being switch activated by a compressive holding action of the cartridge.

Another objective of the present invention is to provide a flashlight having a single flat depressible connector which can be reliably activated from any section of its outer casing while not losing its resiliency over time.

A further objective of the present invention is to provide a disposable flashlight which will minimize the possibility of shorting.

A further objective of the present invention is to provide a disposable flashlight in which the activator will not break off after extended use.

A still further objective of the present invention is to provide a disposable flashlight which will reliably operate when used with cardboard advertising copy.

SUMMARY OF THE INVENTION

In accordance with the present invention a flexible miniature flashlight having an improved activator is disclosed: The flashlight comprises a hollow flexible outer casing having first and second ends, a top cover member for attachment to the first end of the flexible outer casing and a bottom cover member for attachment to a second end of the outer casing. The top cover member has an aperture for securing an electric lighting device. The flashlight further contains battery holding means for placement within the casing. The holder means comprises back to back jackets for holding respective first and second electric batteries, the positive terminal of the first battery being in proximity to the bottom cover member, and the positive terminal of the second battery being in proximity to the top cover member. An electric lighting means extends through the top cover aperture and is in electrical contact with the batteries. Finally, the invention incorporates a mechanical contact means in electrical contact with the positive terminal of the first battery. The contact means comprises a connector in contact with the positive terminal of a first battery, a flat metal shield held rigid by the connector and extending substantially parallel to the inside surface of the casing, the metal shield further having an extension bent inwardly toward the negative terminal of the second battery. When the shield is bent from any location on the outer periphery of the flexible outer casing, the extension makes contact with the battery completes the electrical circuit between the batteries and activates the electric light.

BRIEF DESCRIPTION OF THE DRAWINGS

FIG. 1 is a perspective view of the disposable flashlight of the present invention.

FIG. 2 is an exploded view of the disposable flashlight of the present invention.

FIG. 3 is a section view of the disposable flashlight along line 3—3 of FIG. 1.

FIG. 4 is a section view along line 5—5 of the FIG. 1.

FIG. 5 is a perspective of the contact and connector jacket of the present invention.

FIG. 6 is a section view of the disposable flashlight of the alternative embodiment.

DETAILED DESCRIPTION OF THE PREFERRED EMBODIMENT

The present invention is described with reference to the enclosed figures wherein the same numbers are used where applicable. Referring to FIG. 1, flashlight 10 is provided with a flexible hollow outer casing 11 having a top end cap member 12 fixed at the upper open portion of the casing. The top end cap 12 rests within the outer casing and has a central aperture 12*a* to receive and retain the upper portion of an electric lamp 14.

As shown in the exploded view of FIG. 2, the flashlight includes a lower or bottom end cap member 16. The lower end cap member 16 incorporates an ear flap 18 with hole 18*a* which facilitates the attachment of a chain or string so that the flexible flashlight can be attached to automobile keys and the like. The outer flexible casing 12 is hollow and retains a centrally located holding case 20 which stores and supports two batteries 22 and 24. While not shown the casing may hold a paper or cardboard promotional sleeve. The holding case 20 comprises a pair of concave battery cradles 26. The cradles 26 are joined in a back-to-back relationship and their sides form respective front 28 and rear walls 28*a* of the holder. A section of one of the cradles 28*b* is broken away thereby exposing the side of one of the batteries. Batteries 22 and 24 are nested within the cradles and are retained at the top end by stop pieces 30 attached to the holder at the end proximate to the electric lamp.

Batteries 22 and 24 are uninsulated and each respective cannister 32 operates as a negative terminal. As shown in FIGS. 3 and 4, battery 22 includes a center post positive terminal 34 disposed proximate to the bottom end cap member 16. Battery 24 has a center post positive terminal 36 oppositely facing and arranged at the top of the holding case. Batteries 22 and 24 may be of the alkaline variety well known in the industry.

Electric lamp 14 is conventional and is retained within the aperture in the top end cap member 12. One terminal of the electric lamp is attached or welded to the positive terminal of battery 22 and the other terminal is attached to the uninsulated negative casing of battery 24. Electric lamp 14 therefore remains in electric contact with the batteries.

Referring to FIG. 2, the activator 36 for completing an electric circuit between the two batteries of the preferred embodiment is shown. The activator is a single component comprising a contact 38 and flat metallic shield member 40 with an activation extension 42. The contact member 38 has a connector 44 and metallic connection jacket 46 which is bent at a right angle relative to the flat shield portion 40. As shown in FIG. 5, the connector and connection jacket attach to the positive terminal of battery 22.

The flat metallic shield 40 which can be constructed from a conductive metal such as copper, aluminum or nickel has a surface area which substantially covers the inner surface of outer casing 11. When placed within the holding case, the contact rests flush with respect to the bottom end cap 16 and the metallic shield 40 extends parallel to the holder case 20 and the surface of the batteries along the inside surface of the outer case. The flat metal shield 40 is held rigid by the connector 44 and connector jacket 46 and functions as a resilient member.

The metallic shield portion includes an activation extension 42 which is which is also resilient and which is retained in proximity to the negative outer terminal of battery 24, nested in the cradle with broken away side wall. The extension 42 is bent inward and serves as a contact point. As shown in the preferred embodiment, activation extension 42 extends parallel to the surface of battery 24.

The operation of the flashlight is described with respect to the Figures and most notably FIG. 4. The flashlight of the preferred embodiment comprises a resilient outer casing 11 containing a holder 20 for two uninsulated batteries. A contact member 38 is connected to the positive terminal of battery 22 and a metallic shield 40 extending perpendicular to the contact member is held rigid by the contact member and extends parallel to the surface of the batteries along the inside wall of the resilient outer casing 11.

When the outer casing 11 is depressed, the metallic shield member is accordingly bent inward and the activation extension 42 contacts the negative outer jacket of battery 22, thereby completing the circuit between the positive terminal of battery 22 and the negative side wall terminal of battery 24. The metallic shield may be separate from the hollow casing by an advertising or promotional paper sleeve (not shown). It is to be appreciated by those skilled in the art that the metallic conductive element can contact the uninsulated battery at any point, and those skilled in the art will immediately recognize that the extension may take numerous forms other than that disclosed and described.

When the extension makes contact with the negative casing of battery 24, a circuit is completed between batteries 22, 24 through the contact member 38, flat metallic shield 40 and activation extension 42. When the outer casing is released, the resilient metallic shield 40 and activation extension 42 return to their initial position, thereby breaking the circuit. Because the metallic shield member 40 has a surface area substantially equal to that of a side of the outer casing, the flashlight will activate upon the application of pressure at any point along the outer casing 11.

An alternative embodiment of the invention is shown in FIG. 6. The alternative embodiment is identical to that of the first embodiment, except that contact 36*a* is shorter and the flat metallic shield 40*a* extends at a slight angle, substantially parallel to the inside surface of the hollow casing. This configuration avoids problems associated with placing a thicker promotional or advertisement sleeve within the casing.

While the present invention has been described with respect to a preferred embodiment, it will be readily understood by those skilled in the art that other embodiments fall within the spirit and scope of the invention and that the true nature and scope of the present invention should be examined with reference to the claims appended hereto. Specifically, it will imediately be apparent to those skilled in the art that the present invention is applicable to flashlights which utilize insulated batteries. In such flashlights, a conductive strip extends up the side of one of the batteries from its negative terminal. The activator in the present invention can be used to make contact with such a strip.

What is claimed is:

1. A flexible miniature flashlight having an improved activator comprising;

a hollow flexible outer casing having first and second ends;

a top end cap member for attachment to the first end of the flexible outer casing and a bottom end cap member for attachment to a second end of said outer casing, said top end cap member having an aperture for receiving an electric lamp device;

battery holding means for placement within said outer casing, said holding means comprising concave jackets for holding respective first and second electric batteries, the positive terminal of said first battery being in proximity to said bottom end cap member and the positive terminal of said second battery being in proximity to said to end cap member;

electric lamp means in electrical contact with said batteries and extending through said aperture;

mechanical activation means comprising a contact member in electrical contact with the positive terminal of said first battery, a resilient metallic shield having a surface area substantially equal to a side of said outer casing and extending substantially parallel to the inside surface of said outer casing, said metallic shield being held rigid by said contact member, said metallic shield having an activator extending inwardly toward a negative terminal of said second battery, whereby when said outer casing is depressed, said metallic shield bends inwardly and said activator completes a circuit between said batteries and lights said flashlight.

2. The disposable flashlight of claim 1 wherein a portion of the concave jacket holding said second battery is broken away.

3. The disposable flashlight as recited in claim 1 wherein the mechanical activator means is copper.

4. A disposable flashlight comprising:

a hollow flexible outer casing having a first end and a second end;

a top end cap member for attachment to said first end, said top end cap member having an aperture for receiving an electric lamp device;

a bottom end cap for attachment to said second end of said hollow casing; a battery holding member placed within said outer casing, said holding member comprising parallel first and second concave battery jackets;

a first battery having a positive terminal and a negative terminal, said first battery being placed in the first jacket with its positive terminal proximate to said bottom end cap member;

a second battery having a positive terminal and a negative terminal, said second battery being placed in said second jacket with its positive terminal proximate to said top end cap member;

electric lamp means in electrical contact with said batteries and extending through said aperture; and a mechanical activator comprising an electric contact member in contact with the positive terminal of said first battery and extending parallel to said bottom end cap member, a flexible metal shield held rigid by said contact member and having a surface area substantially equal to a side of said outer casing said metal shield extending substantially parallel to an interior side surface of said outer casing, said metallic shield having an inwardly bent extension proximate to said negative terminal of said second battery, whereby when said outer casing is depresses, the metallic shield bends inwardly and said activator completes a circuit between said batteries and lights said flashlight.

5. The disposable flashlight of claim 4 wherein said contact member includes a connector and connector jacket for contacting said first battery.

6. The disposable flashlight of claim 4 wherein said battery holding member further comprises end stop means for securing said batteries.

7. The disposable flashlight of claim 4 wherein a portion of the concave jacket holding said second battery is broken away thereby exposing the negative terminal of said second battery.

8. The disposable flashlight as recited in claim 4 wherein the mechanical activator means is copper.

* * * * *

UNITED STATES PATENT AND TRADEMARK OFFICE

CERTIFICATE OF CORRECTION

PATENT NO. : 4,926,300

DATED : May 15, 1990

INVENTOR(S) : Gene O. Ralston

It is certified that error appears in the above-identified patent and that said Letters Patent is hereby corrected as shown below:

On the first page of the patent, in the title:

Delete "FIELD OF THE INVENTION"

Top of Column 1 in the title:

Delete "FIELD OF THE INVENTION"

Signed and Sealed this

Second Day of July, 1991

*Attest:*

*Attesting Officer*

HARRY F. MANBECK, JR.

*Commissioner of Patents and Trademarks*